US005440848A

United States Patent [19]

Deffet

[11] Patent Number: 5,440,848

[45] Date of Patent: Aug. 15, 1995

[54] METAL STUDS TO REPLACE WOOD STUDS

[75] Inventor: Thomas H. Deffet, Ft. Myers, Fla.

[73] Assignee: H. L. Stud, Inc., Columbus, Ohio

[21] Appl. No.: 946,887

[22] Filed: Sep. 18, 1992

[51] Int. Cl.[6] ..... E04B 5/00

[52] U.S. Cl. ..... 52/376; 52/660; 52/733.3

[58] Field of Search ..... 52/696, 720, 721, 731.1, 52/376, 660, 105

[56] References Cited

U.S. PATENT DOCUMENTS

| | | | |
|---|---|---|---|
| 1,665,556 | 4/1928 | Liptak | 52/506.03 X |
| 1,867,449 | 7/1932 | Ecket et al. | 52/720 |
| 2,339,220 | 1/1944 | Crowley | 52/236.6 X |
| 2,699,669 | 1/1955 | Nelsson . | |
| 3,482,369 | 12/1969 | Burke | 52/720 |
| 4,001,993 | 1/1977 | Daniels | 52/376 |
| 4,916,871 | 4/1990 | Anderson | 52/105 X |
| 4,927,696 | 5/1990 | Berg | 52/105 X |
| 5,157,883 | 10/1992 | Meyer | 52/357 |
| 5,222,335 | 6/1993 | Petrecca | 52/105 |

FOREIGN PATENT DOCUMENTS

| | | |
|---|---|---|
| 4514972 | 2/1974 | Australia . |
| 1342059 | 9/1963 | France . |
| 2085789 | 12/1971 | France . |

*Primary Examiner*—Lanna Mai

*Attorney, Agent, or Firm*—Thomas E. O'Connor, Jr.

[57] ABSTRACT

Metal studs to replace vertical wood studs for use in the framing of walls of partitions. The ends of the metal studs are configured to allow convenient and rapid use by carpenters in the same manner that wood studs are used in assembling the frame for partitions, walls or sections thereof, and without any need for additional training of or new tools for the carpenters. The unique configuration having a flange or leg on both ends of only one side of the metal studs, allowing the interior surface of the flanges to conveniently interconnect with the respective vertical surface of the top (ceiling) and bottom (floor) wood plates. Each end of the central portion of the stud has a flange to interface with the exposed horizontal surface of top and bottom wood plates. This unique configuration allows the metal studs to be attached conveniently and inexpensively, by nailing to the top and bottom wood plates.

1 Claim, 2 Drawing Sheets

METAL STUDS TO REPLACE WOOD STUDS

CROSS-REFERENCE TO RELATED APPLICATIONS

There are no prior applications on the basis of which priority is being claimed, the identity of which must be identified in accordance with 37 C.F.R. §1.78 and Section 201.11 of the M.P.E.P.

STATEMENT AS TO RIGHTS TO INVENTIONS MADE UNDER FEDERALLY SPONSORED RESEARCH AND DEVELOPMENT

No federally sponsored research and development was involved in the invention that is the subject of this application.

BACKGROUND

In view of the shortage of lumber and the fact that as time goes on lumber will become even more scarce, it will not be possible, without paying very substantial increases in the price of lumber, to make available the substantial number of studs that will be required for the anticipated increases in number of shelter building programs now being undertaken in the United States.

(1) Technical Field

The present invention relates to a metal stud, a support structure or the like, that can be operably connected to wood framing members or plates to construct walls, which are in turn incorporated into a building, such as a house. The support structure of this invention, e.g., a metal channel member or stud, is adapted to be connected with wood plates, which are positioned along the floor and along the ceiling. The support members and plates are joined by a number of connections which will enable an operator to select in his opinion a strong and sturdy connection between the metal stud and wood plates.

(2) Description of the Related Art

It has been common practice for many years to separate the various rooms in the house (or other buildings) by partition walls which are rigid and strong and provide a substantial separation between the rooms so that the rooms are sound proofed from each as much as possible. This requires a substantial amount of lumber. However, the supply of lumber is getting scare. As a result, the cost of building a house or other building of wood has increased during recent years, particularly if the house is formed entirely of lumber.

Wood has its shortcomings. Wood can warp and go out of shape when it becomes wet. Vermin of various kind can eat away at wood. Despite these shortcomings, wood had been preferred for home construction despite the fact that wood is more expensive by about 30% as of now over the cost of building a house using part metal. The manufacturing techniques for building with metal are increasing rapidly and these new techniques tip the scales more and more to the building of homes of metal, or wherein a large portion of the home is built of metal.

SUMMARY

This invention relates to a metal stud to replace conventional wood studs for use as vertical support members in forming walls or partitions in houses, apartments, office or other buildings. The metal stud of this invention is comprised of a rectangular sheet metal strip bent into a channel like bracket shaped form, with an open rectangular cross-section to define three walls comprising two parallel side walls and a central wall. The metal stud further is comprised of extensions on and integral to each end of only one of said side walls to form a leg to provide a flange for each end and a flange integral and perpendicular to each end of such central wall. When used in carpentry work, the metal studs enable the use of wood plates in combination with metal studs to build, shape and size the rooms and partitions of a the building or house under construction.

BRIEF DESCRIPTION OF THE DRAWINGS

Referring now to the drawings wherein similar reference characters refer to similar parts throughout the several views.

DESCRIPTION OF THE PREFERRED EMBODIMENT

Figure 1A:
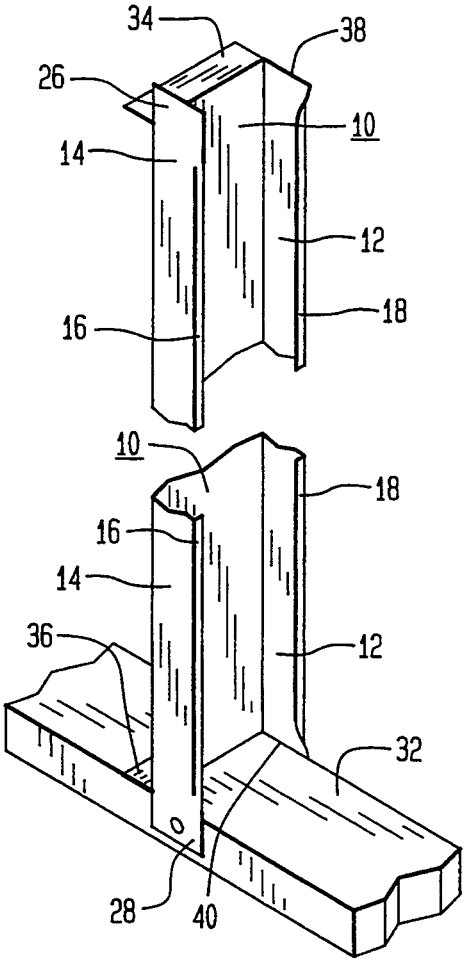
FIGS. 1A and 1B are perspective views of the interconnection between a metal channel member or stud and the floor and ceiling wood plates wherein the central channel member is bent backwardly at the floor and ceiling plates, and one of the side flanges or legs is extending to provide a nailing element to the lower and upper plates at the floor and ceiling members.
Figure 1B:
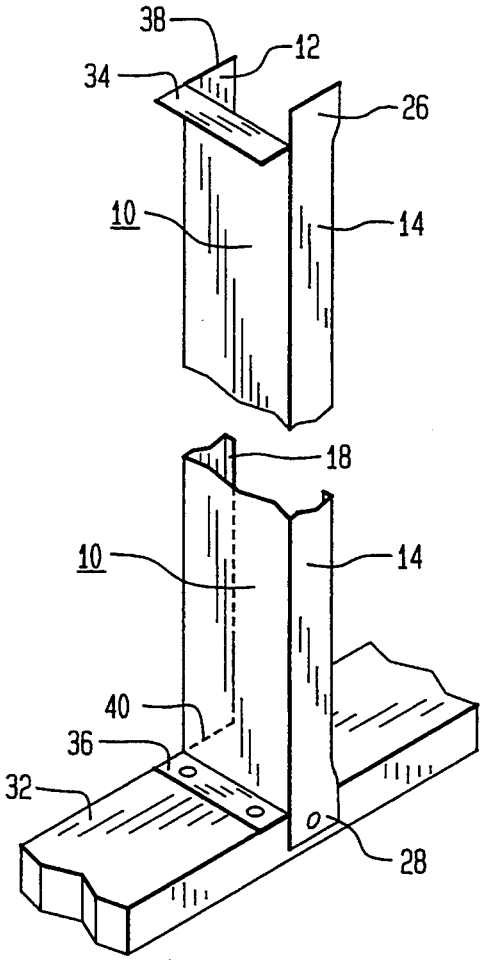

Referring now to the drawings and particularly to FIGS. 1A and 1B, there is shown a stud or support member 10 which is comprised of a central part or wall, a side wall 12 and another side wall 14. These three walls are dispossessed in a channel shaped or bracket shaped configuration as shown in FIGS. 1A and 1B. The metal stud is formed to have exterior dimensions generally similar to those of the conventionally finished wood stud, consisting of the so-called 2"×2" and 2"×4" and 2"×6" dimensions, the real dimensions of which are, when used in the carpentry work, wood plates in combination with metal studs to shape the size of the rooms of the building and to construct the building.

A flange 26 is formed integrally with the side wall 14 and extends upwardly in the same plane as shown in FIGS. 1A and 1B in a vertical direction. Similarly, a flange 28 is formed integrally with the side wall 14 and extends downwardly in the same plane as the side wall as shown in FIGS. 1A and 1B. Only one flange 26 of the channel member 10, as shown best in FIG. 1A, extends from the top end along the side edge of the top wood plate (not shown), and fasteners are employed to secure the flange 26 to the side of the wood plates. Similarly, only one flange 28 of the stud 10, as shown in FIG. 1A, extends from the bottom end along the side edge of the wood member or plate 32, and fasteners are employed to secure the flange 28 to the side of the plate 32.

The central wall of the channel or stud 10 is positioned crosswise along the top side of the wood plate or panel 32 and its flange 28 extends down along the side of the wood panel 32. A flange 36 is formed at the bottom end of the stud 10 as shown in FIGS. 1A and 1B, bending it rewardly at a 90 degree angle. The flange 36 is further secured by fasteners to the wood plate 32. A flange 34 similarly is formed at the upper end of the stud 10 and is secured to an upper plate (not shown). As shown in FIGS. 1A and 1B, one side wall 14 contains extensions integral to form a leg to provide the flanges 26 and 28 at each end of the stud 10. The legs or flanges 26 and 28 extend along side edges of the wood plates 32 and fasteners are employed to secure the legs 28 to the side plates 32.

The flange 36 is formed at the bottom of the stud 10 by bending it downwardly as shown in FIG. 1B, and fasteners are employed to secure the flange to the bottom plate 32. The flange 34 is similarly formed at the top of the stud 10 and is secured to the top plate 32 (not shown). In particular, a top portion of the channel shaped stud 10 is bent backward to form each of the flanges 34 and 36. The thickness or width of flanges 34 and 35 is equal to that of the stud 10, e.g., "2×2 or the 2"×4 or the 2"×6". One side of the flanges 34 and 36 formed of the bent strip, provides a footing to enable the flanges 34 and 36 to secure its connected channel member 10 to the wood members or plates 32. Thus, the central portion or wall of the channel or stud 10 extends along the rear or top edge of the plate 32 and is secured by fasteners driven in perpendicularly to the rear surface of the plate 32.

In this invention, one of the side flanges or legs of the metal stud are cut off and the central channel member of the metal stud is cut off or bent over in order to provide a strong and desirable connection between a multiple of the "2×2" wood plate member, the "4×4" wood plate member, or 2"×6" wood plate member to provide a substantial support for the construction of partition walls.

The method of making a wall from the studs 10 of this invention comprises the step of positioning two wooden plates substantially parallel to each other. A channel shaped member or stud 10 is positioned perpendicular to and over the wood plates 32 and fasteners are inserted through the side flanges 26 and 28 into the side edges of the wood plates 32 As shown in FIGS. 1A and 1B, the flanges or legs 26 and 28 extend from only the single side wall 14 and are placed over the side edges of the wood members 32.

Figure 2A:
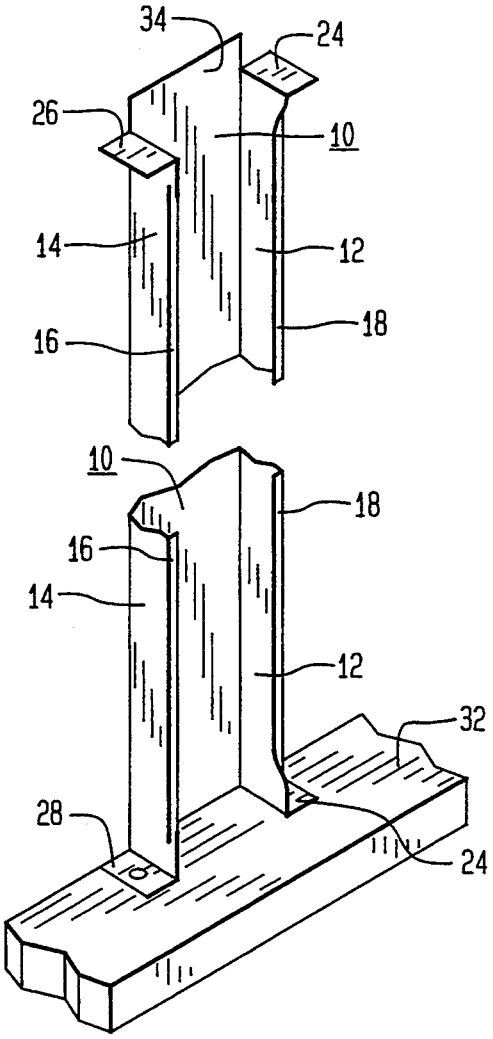
FIGS. 2A and 2B are constructions wherein the central metal channel member or metal stud is positioned longitudinally of the wood plate members and extends downwardly and upwardly along the sides of the wood plates to provide nailing strips through the channel shaped members into the wood members. In this construction, the lower and upper ends of the flanges are bend outwardly to provide nailing strips to permit fasteners to extend through the flanges of the channel and into the wood plates.
Figure 2B:
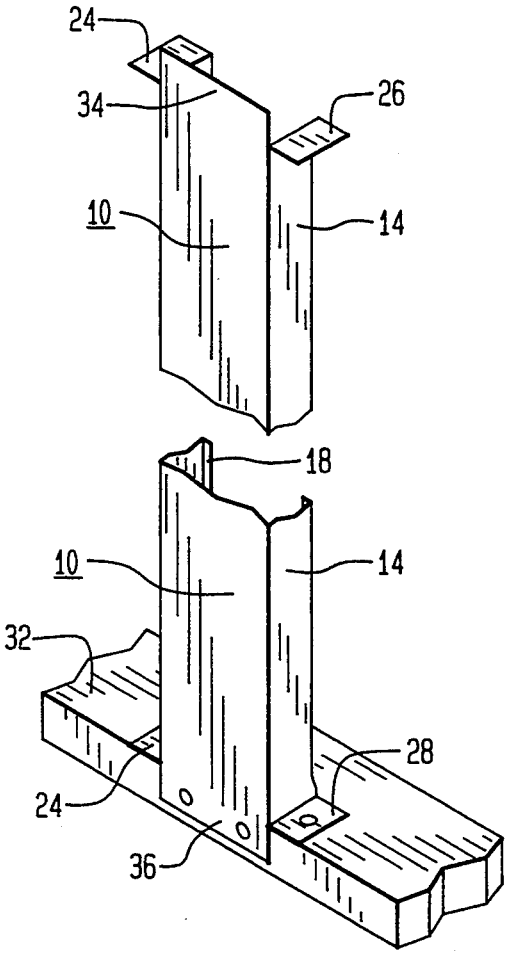

As shown in FIGS. 2A and 2B, the central wall of the channel member 10 is positioned longitudinally of the plate members 32 and has flanges 36 at each end which extend downwardly and upwardly respectively along the sides of the wood plates 32 to provide nailing strips through the channel shaped members into the wood members 36. In this construction, each of the lower and upper ends of the flanges 24 and 26 are bent outwardly to provide nailing strips to permit fasteners to extend through the flanges 28 and into the wood plates 32.

Under the preferred embodiment of the invention, the metal studs 10 are used in connection with, for example, the laying out of a house which comprises positioning two wooden members or plates 32 (for positioning along the floor and along the ceiling, with a channel shaped metal plate or stud, interconnecting each pair of wooden plates, and the flanges 34 and 36 are bent backwardly equal to the thickness of 2"×2" or the 2"×4" or the 2"×6" members, and one side of the flange or leg 26 and 28 of the side wall 14 provides a footing or reference of the structure member with regard to the plate so that the support structure is precisely positioned with respect to the wood plates.

FIGS. 2A and 2B are constructions wherein the central channel member 10 is positioned longitudinally of the of the plate member 32 and extends downwardly and upwardly along the sides of the wood plates 32 to provide nailing strips through the channel shaped members into the wood members. In this construction the lower and upper ends of the flanges 24 and 28 are bent outwardly to provide nailing strips to permit fasteners to extend through the flanges 24 and 28 of the channel 10 and into the wood elements 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the following claims.

I claim:

1. An improved metal stud to replace conventional wood studs used as vertical studs in forming walls or partitions in houses, apartments, office or other buildings and adapted to be connected to wood plates, comprising:

a rectangular sheet metal strip bent into a form, with an open rectangular cross-section to define three walls comprising two parallel side walls and a central wall;

extensions on and integral to each end of only one of said side walls extending beyond said central wall to form a leg to provide a flange for each end; and a flange integral and perpendicular to each end of such central wall.

* * * * *